US007131524B2

(12) United States Patent
Wohltmann

(10) Patent No.: US 7,131,524 B2
(45) Date of Patent: Nov. 7, 2006

(54) APPARATUS AND METHOD FOR THE TRANSFER OF ROD-SHAPED ARTICLES

(75) Inventor: Cord Wohltmann, Hamburg (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 10/940,932

(22) Filed: Sep. 15, 2004

(65) Prior Publication Data

US 2005/0077149 A1 Apr. 14, 2005

(30) Foreign Application Priority Data

Sep. 16, 2003 (EP) ..... 03090299

(51) Int. Cl.
*B65G 17/46* (2006.01)

(52) U.S. Cl. ..... 198/471.1; 198/418; 198/430

(58) Field of Classification Search ..... 198/430–432, 198/428, 471.1, 438, 418
See application file for complete search history.

(56) References Cited

U.S. PATENT DOCUMENTS 4,406,197 A 9/1983 Bardenhagen et al.
4,645,063 A * 2/1987 Seragnoli ..... 198/471.1
4,804,079 A * 2/1989 Hensgen et al. ..... 198/471.1
4,827,948 A * 5/1989 Schumacher ..... 198/418
5,267,577 A * 12/1993 Rizzoli et al. ..... 198/471.1
5,327,803 A * 7/1994 deMey, III ..... 198/428
5,908,030 A 6/1999 Coi et al.
6,105,750 A * 8/2000 Belvederi ..... 198/432
6,672,446 B1 * 1/2004 Boldrini et al. ..... 198/471.1

FOREIGN PATENT DOCUMENTS

EP 0838163 4/1998

* cited by examiner

*Primary Examiner*—James R. Bidwell
(74) *Attorney, Agent, or Firm*—Greenblum & Bernstein, P.L.C.

(57) ABSTRACT

An apparatus for transferring rod-shaped articles from a longitudinal conveyor transporting the articles in a longitudinal axial direction onto a transverse conveyor transporting the articles in a transverse axial direction, in which the directions of transport of the longitudinal conveyor and the transverse conveyor are oriented transversely to each other. The apparatus includes a conveying device having receptacles, and the receptacles are structured and arranged to receive a plurality of articles transported adjacent each other on a track of the longitudinal conveyor and to discharge the articles as a plurality of groups of articles onto different tracks of the transverse conveyor.

25 Claims, 3 Drawing Sheets

APPARATUS AND METHOD FOR THE TRANSFER OF ROD-SHAPED ARTICLES

CROSS-REFERENCE TO RELATED APPLICATIONS

The present application claims priority under 35 U.S.C. § 119 of European Patent Application No. 03 09 0299.3 filed Sep. 16, 2003, the disclosure of which is expressly incorporated by reference herein in its entirety.

BACKGROUND OF THE INVENTION

1. Field of the Invention

The invention concerns an apparatus for the transfer of rod-shaped articles, in particular cigarettes, from a longitudinal conveyor for longitudinal axial conveying of the articles onto a transverse conveyor for transverse axial conveying of the articles. The directions of transport for the longitudinal conveyor and for the transverse conveyor run transversely to each other. The apparatus includes a conveying device with receptacles for receiving several articles from the longitudinal conveyor and for discharging the received articles onto the transverse conveyor.

Furthermore, the invention concerns a method for the transfer of rod-shaped articles, in particular cigarettes, from a longitudinal conveyor for longitudinal axial conveying of the articles onto a transverse conveyor for transverse axial conveying of the articles, in which the directions of transport for the longitudinal conveyor and for the transverse conveyor run transversely to each other. The method includes receiving several rod-shaped articles from the longitudinal conveyor via a conveying device, rotating the conveying device and so moving the articles through a predetermined angle, and discharging the articles onto the transverse conveyor.

2. Discussion of Background Information

Apparatuses and methods of this kind are used in particular in the tobacco-processing industry. In a continuous cigarette rod-making machine, continuous rods of tobacco are made and usually divided into single or double-length tobacco sticks. The tobacco sticks are conveyed in their longitudinal direction and must be transferred for further processing, e.g. for attaching a filter, to a filter-attaching machine. For this purpose the tobacco sticks must usually be transferred from their longitudinal axial transport direction to a transverse axial transport direction, wherein the directions of transport also run transversely to each other.

There are numerous apparatuses and methods for transfer of the rod-shaped articles from a longitudinal conveyor onto a transverse conveyor. Known apparatuses have a conveying device which receives several articles arranged adjacent to each other on a curved track, and discharges them successively to a drum forming a track. Apparatuses and methods of this kind, however, have inadequate productivity, as the speed of transport of the conveying device and drum must be adapted to the transfer of single articles. In other words, only one article can be discharged to the transverse conveyor at a time. Furthermore, the known apparatuses and methods have only limited flexibility, as discharge can be made only to a single track.

SUMMARY OF THE INVENTION

Therefore, the present invention provides a compact and flexible apparatus for the transfer of rod-shaped articles with a high throughput capacity. Furthermore, the invention provides a simple and flexible method for the transfer of rod-shaped articles with a high throughput capacity.

According to the invention, an apparatus with the characteristics mentioned hereinbefore includes a conveying device designed for receiving more than two articles which are all delivered adjacent to each other on a track of the longitudinal conveyor, and for discharging several groups of articles onto different tracks of the transverse conveyor. As a result, in a surprisingly simple and particularly effective manner, the productivity of the apparatus is increased as several articles can be received at the same time and at a common receiving position, and discharged again at different times and at different discharge positions. Furthermore, the apparatus according to the invention allows very flexible processing, as discharge to different tracks ensures simultaneous processing of different articles. Thus, for example a group of articles can be conveyed to a subsequent filter-attaching machine, while with the same apparatus another group of articles can be conveyed to a packing unit.

Preferably, the conveying device includes a single drum with several receptacles for simultaneously receiving in each case several articles from the longitudinal conveyor. In particular, each receptacle is designed for simultaneously receiving four articles and for discharging the articles in two groups of two. With this embodiment, in a particularly compact and simple manner, a transfer of articles from a continuous cigarette rod-making machine for making four continuous rods arranged adjacent to each other to a subsequent apparatus is provided.

In an advantageous embodiment of the invention, both transfer drums of the transverse conveyor or their axes of rotation are arranged above the track of the longitudinal conveyor, resulting in an advantageous operating height. Furthermore, lifting of the articles off the-longitudinal conveyor from above is technically/structurally easier and also more reliable than reception (engagement) from below or from the side.

Moreover, according to the invention, a method of the type mentioned hereinbefore includes several articles which are arranged adjacent to each other and all delivered on a track of the longitudinal conveyor that are received and discharged in groups to several separate tracks of the transverse conveyor. By this method, high-throughput transfer in a compact and flexible form is ensured.

Advantageously, four articles are received simultaneously and in each case two articles are discharged in a group after movement through an angle of 90° or 270°. This method allows in a structurally, particularly simple manner the high-throughput, flexible transfer of articles.

The present invention is directed to an apparatus for transferring rod-shaped articles from a longitudinal conveyor transporting the articles in a longitudinal axial direction onto a transverse conveyor transporting the articles in a transverse axial direction, in which the directions of transport of the longitudinal conveyor and the transverse conveyor are oriented transversely to each other. The apparatus includes a conveying device having receptacles, and the receptacles are structured and arranged to receive a plurality of articles transported adjacent each other on a track of the longitudinal conveyor and to discharge the articles as a plurality of groups of articles onto different tracks of the transverse conveyor.

In accordance with a feature of the invention, the articles can include cigarettes.

According to another feature of the invention, the plurality of articles may include more than two articles, and at least one of the plurality of groups can include at least two articles.

Moreover, the conveying device can include a single drum with several receptacles structured and arranged to simultaneously receive more than two articles from the longitudinal conveyor. The conveying device may be structured and arranged to simultaneously receive four articles and to discharge the articles in two groups of two. Further, the receptacles can be structured and arranged to simultaneously receive four articles and to discharge the articles in two groups of two. Each of the receptacles may be structured and arranged to simultaneously receive four articles and to discharge the articles in two groups of two. Still further, the drum may include a plurality of arms, and each arm can be coupled to a receptacle. The drum can include between seven and nine arms, and each receptacle may be structured and arranged to receive four articles. Also, the drum can be rotatably driven about an axis of rotation oriented transversely to the direction of transport the longitudinal conveyor, and the axis of rotation can be oriented in the direction of transport of the transverse conveyor. The receptacles may be rotatably driven relative to the drum, and the drum can include a plurality of arms, in which each arm can be coupled to a receptacle, and the arms can be rotatably driven relative to the drum.

According to still another feature of the invention, the receptacles may be arranged to engage the articles from above.

In accordance with the invention, the different tracks of the transverse conveyor may be two separate transfer drums. The two transfer drums can be functionally connected to the drum. Moreover, the two transfer drums can be arranged above the track of the longitudinal conveyor, and axes of rotation of the two transfer drums may be arranged above the track of the longitudinal conveyor.

According to another feature of the instant invention, the two transfer drums can be drivable in opposite directions.

The present invention is directed to a method for transferring rod-shaped articles from a longitudinal conveyor transporting the articles in a longitudinal axial direction onto a transverse conveyor transporting the articles in a transverse axial direction, in which the directions of transport of the longitudinal conveyor and the transverse conveyor are oriented transversely to each other. The method includes receiving a plurality of rod-shaped articles arranged adjacent each other on a track of the longitudinal conveyor, rotating the plurality of articles through a predetermined angle, and discharging the plurality of articles in groups onto separate tracks of the transverse conveyor. The plurality of rod-shaped articles can be cigarettes.

According to the invention, a conveying device can be provided to receive, rotate, and discharge the plurality of articles.

In accordance with another feature of the invention, the discharging of the groups of articles can occur with staggering in time and place.

According to still another feature of the instant invention, the plurality of articles can include four articles, and the receiving may include simultaneously receiving the four articles.

In accordance with still yet another feature of the present invention, the discharging can include discharging a first group of articles after rotating the articles through an angle of 90° and discharging a second group of articles after rotating the second group through and angle of 270°.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein FIG. 1 schematically illustrates of the apparatus according to the invention with the single-track longitudinal conveyor, the conveying device, and the twin-track transverse conveyor.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
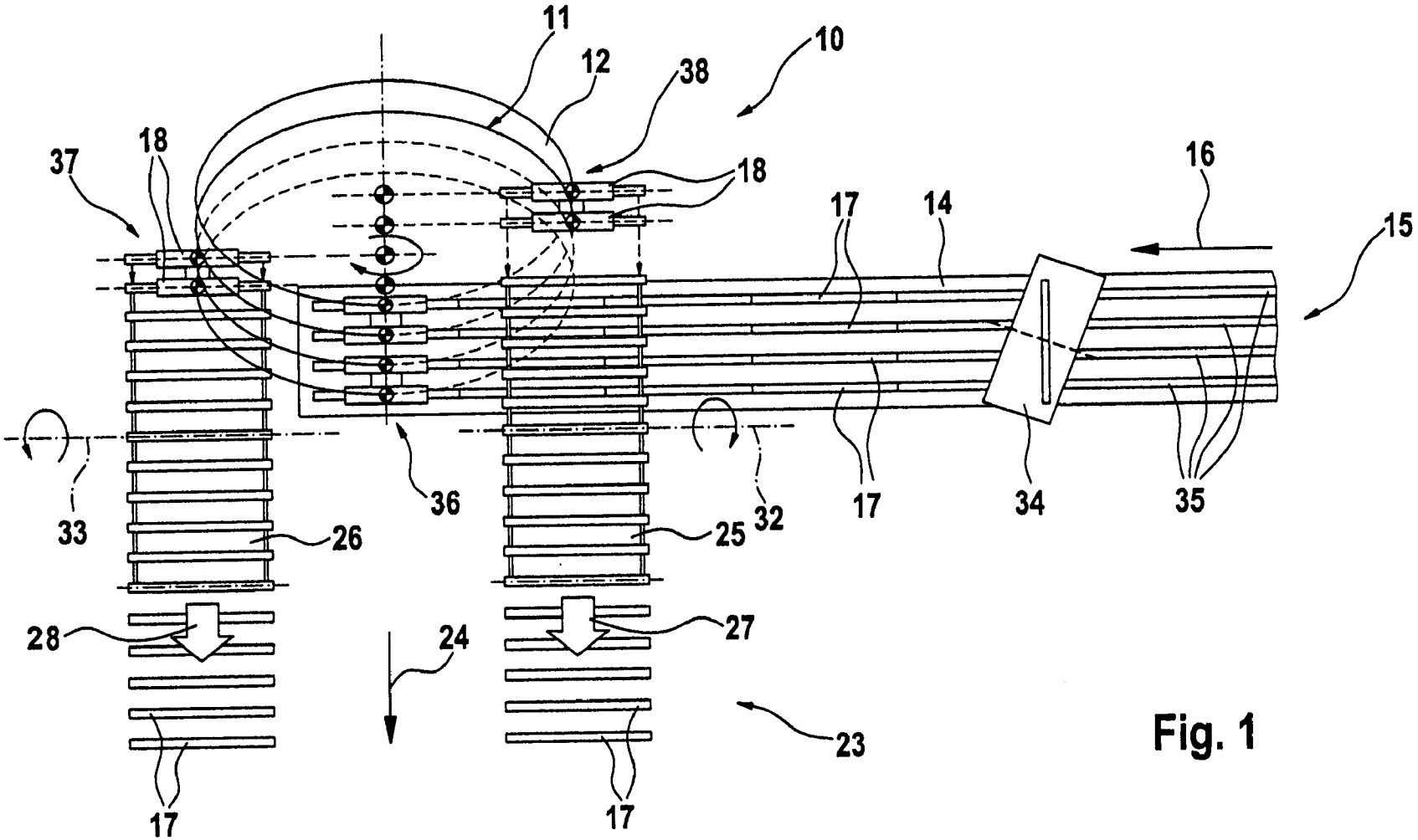
Figure 2:
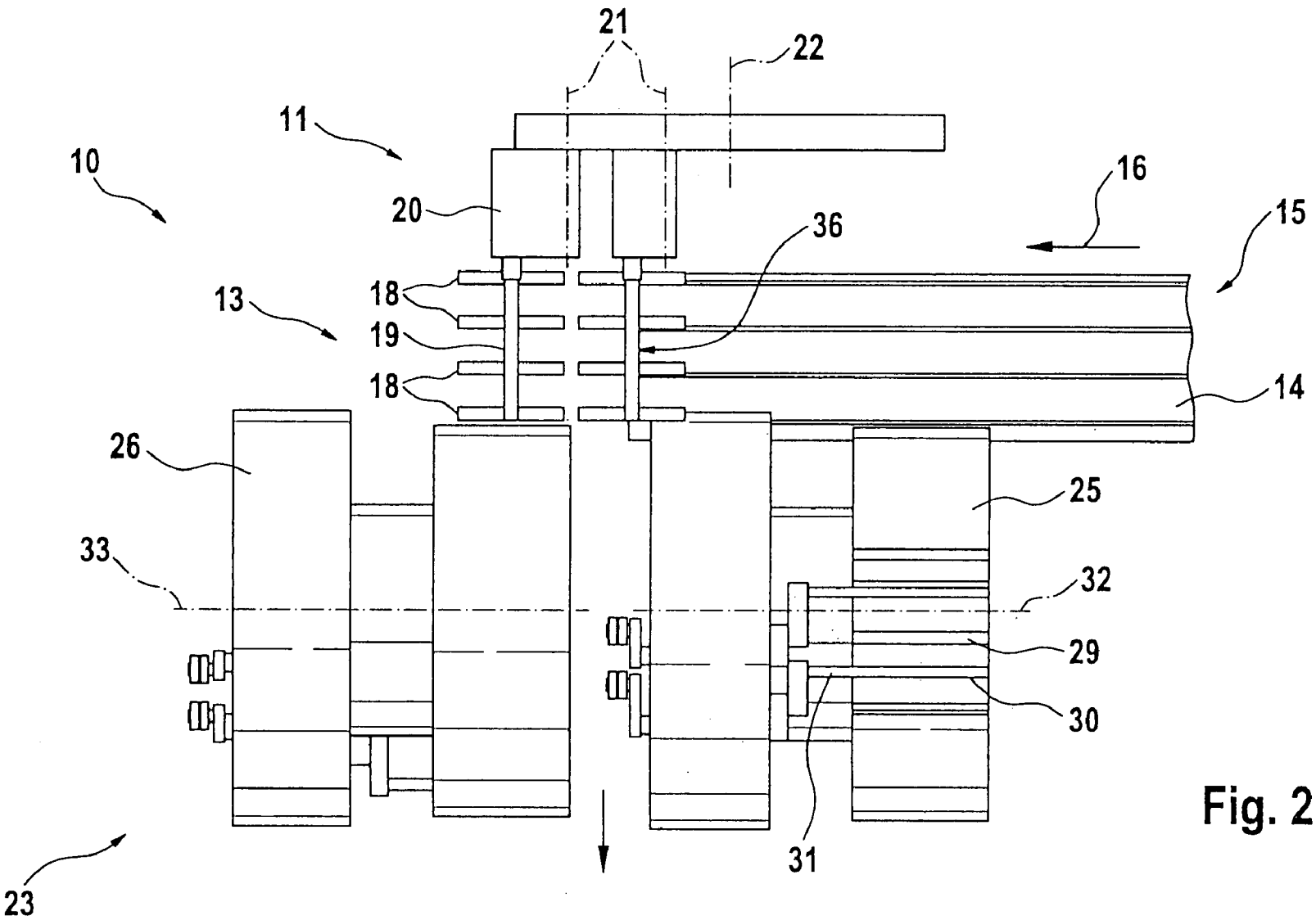
FIG. 2 illustrates the apparatus with the longitudinal conveyor, the conveying device, and transverse conveyor in plan view.
Figure 3:
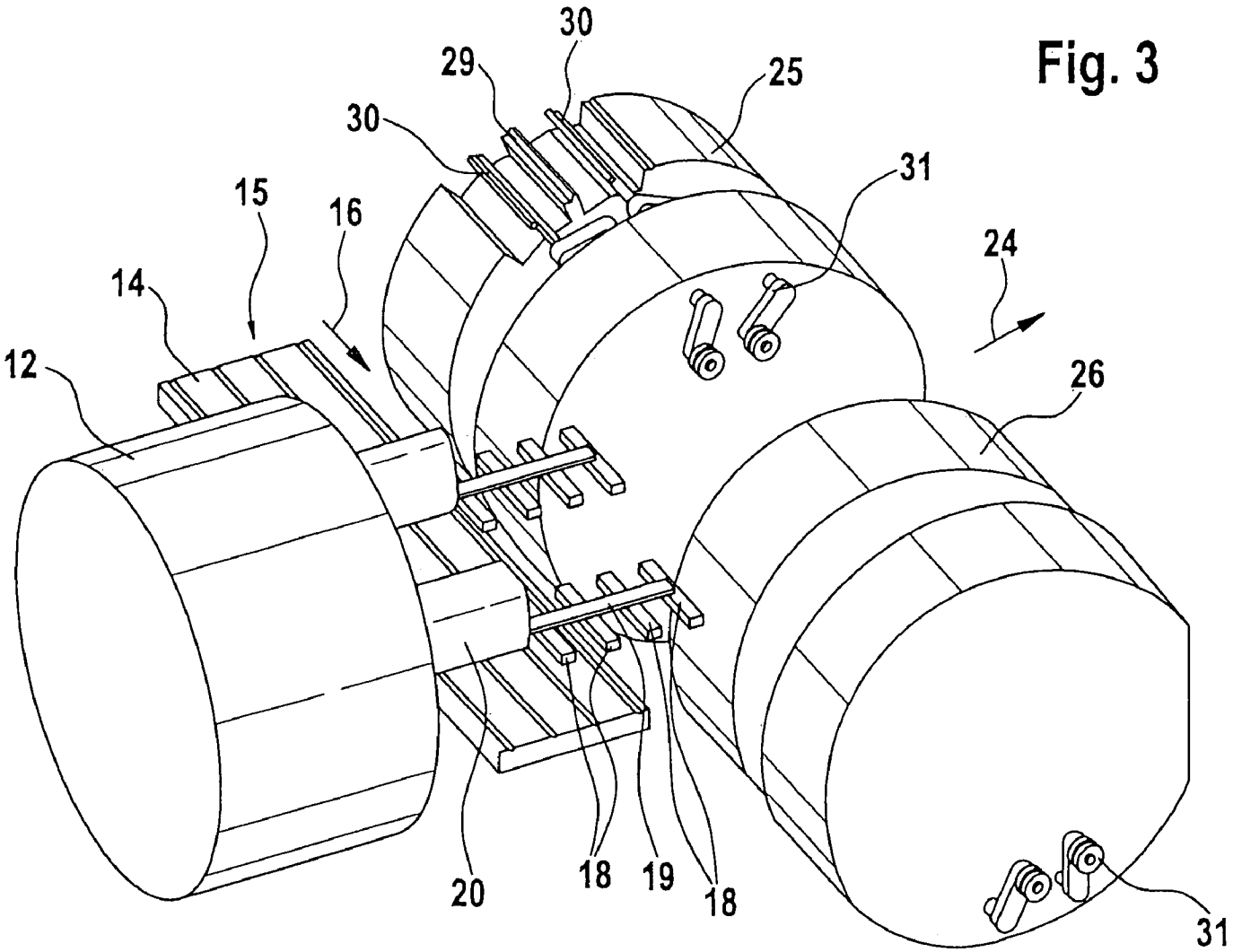
FIG. 3 illustrates the apparatus depicted in FIG. 2 in a perspective view that is from obliquely above and behind.

The apparatus shown in FIGS. 1–3 is used for the transfer of articles from a longitudinal conveyor of a continuous cigarette rod-making machine onto a transverse conveyor.

The apparatus 10 includes a conveying device 11, which is also referred to as a "spider," comprising a drum 12. In the conventional form, drum 12 has several receptacles 13, which are designed for simultaneously receiving (engaging) four articles 17 that are delivered longitudinally axially on a track 14 of a longitudinal conveyor 15 in a transport direction (arrow 16). Track 14 in the embodiment shown is a level track, however, it is contemplated that track 14 can be designed in other forms, e.g., curved or stepped/vertically offset. Receptacles 13 each have four trough elements 18 which are designed for receiving and holding articles 17 during transport. Trough elements 18 are connected, e.g., to vacuum pipes or the like (not shown), and are arranged parallel and adjacent to each other while being uniformly spaced apart and attached to an arm 19, which is in turn preferably releasably attached to a rotary (rotatable) body 20. Several rotary bodies 20 with corresponding arms 19 with receptacles 13 arranged thereon are evenly distributed over the circumference of drum 12. In this regard, a number of seven to nine rotary bodies 20 or arms 19 is advantageous. Axes of rotation 21 of rotary bodies 20 run parallel but offset from axis of rotation 22 of drum 12. Each axes of rotation 21 runs eccentrically to its respective rotary body 20, such that rotary bodies 20 describe an elliptical track curve. Drum 12 and longitudinal conveyor 15 are functionally connected to each other in the region of a receiving position 36.

Rotary bodies 20 are movable relative to drum 12, so that a superimposed movement of rotary bodies 20 relative to drum 12 is possible. Due to the superimposed rotation of drum 12 and of rotary bodies 20, receptacles 13 or trough elements 18 with articles 17 "clinging" to them are kept parallel to a horizontal plane at least during transport from reception to discharge. Behind drum 12 in the direction of transport of articles 17, a transverse conveyor 23 is arranged for removing articles 17 from drum 12. The direction of transport (arrow 24) of transverse conveyor 23 runs transversely to the direction of transport (arrow 16) of longitudinal conveyor 15. Transverse conveyor 23 includes two transfer drums 25 and 26 which form tracks 27 and 28 for carrying away articles 17. Two transfer drums 25 and 26 are functionally connected to drum 12 in the region of a discharge position 37 or 38. For transfer of articles 17 from drum 12, transfer drum 25 has receptacles 29 and 30, in which receptacles 29 are fixed and receptacles 30 are movable. Several receptacles 29 and 30 are evenly distributed over the circumference, and fixed receptacles 29 and movable receptacles 30 are alternately arranged. Movable receptacles 30 are arranged on pivot levers 31. Further, one fixed receptacle 29 and one movable receptacle 30, each, form a unit for receiving a group of articles. Transfer drum 26 has exclusively movable receptacles 30, which are also distributed over the circumference. Receptacles 30 are in turn arranged on pivot levers 31, in which the length of pivot levers 31 on transfer drum 26 and hence the pivot range thereof is larger than that for transfer drum 25.

Axes of rotation 21 of rotary bodies 20 and axis of rotation 22 of drum 12 run transversely to the direction of transport (arrow 16) of longitudinal conveyor 15 and in the direction of transport (arrow 24) of transverse conveyor 23. Both transfer drums 25 and 26 or their axes of rotation 32 and 33 lie above track 14 of longitudinal conveyor 15. Axes of rotation 32 and 33 are aligned with each other and run transversely to axis of rotation 22 of drum 12 and in the direction of transport (arrow 16) of longitudinal conveyor 15. Transfer drums 25 and 26 in the embodiment shown are or can be driven in opposite directions. Further, transfer drums 25 and 26 are arranged in relation to drum 12 in such a way that a first discharge position 37 is formed after an angle of rotation of drum 12 of 90° and a second discharge position 38 is formed after an angle of rotation of drum 12 of a further 180°, that is, 270° from receiving position 36 of articles 17.

Longitudinal conveyor 15 is assigned a separating element 34 in front of conveying device 11 in the direction of transport (arrow 16). Separating element 34 serves to separate articles 17 from continuous rods 35 made in a previous machine.

In embodiments not shown, three or more than four trough elements 18 can also be arranged on a receptacle 13. Also, there is the possibility of varying the number of rotary bodies 20 and hence arms 19 or receptacles 13. Transfer drums 25 and 26 can also be arranged below track 14.

Hereinafter, the principle of the method for the transfer of four articles 17 in two groups of two will be described with the aid of FIGS. 1–3.

Several, preferably four continuous rods 35 of tobacco or the like, which have preferably been made in the previous continuous cigarette rod-making machine (not shown), are conveyed along longitudinal conveyor 15 on single track 14, which lies, e.g., in one plane, to conveying device 11, i.e., drum 12. In front of drum 12 in the direction of transport (arrow 16) of longitudinal conveyor 15, separating element 34 is positioned to simultaneously separate articles 17 from continuous rods 35 across the whole width of track 14. Articles 17 are, e.g., tobacco sticks of single or double cigarette length. The several articles 17 are then conveyed parallel and uniformly adjacent to each other to receiving position 36, where they are received at the same time by drum 12, more particularly, by trough elements 18, e.g., via suction. By rotating drum 12, articles 17 are simultaneously removed from longitudinal conveyor 15. Articles 17 are then pivoted through 90° about axis of rotation 22 (while at receiving position 36 a further set of articles 17 is received by the next set of trough elements), however, articles 17 remain in a horizontal position oriented in the direction of transport (arrow 16) due to superimposed rotation of receptacles 13 relative to drum 12 about axes 21. After rotation through 90°, a first group of articles, e.g., two articles 17, is transferred at a first discharge position 37 to transfer drum 26. In this regard, articles 17 are laid in two movable receptacles 30. After rotation through a further 180°, that is, through a total rotation of 270° from receiving position 36, the second group of articles, preferably also containing two articles 17, are transferred, in the region of discharge position 38, into a fixed receptacle 29 and a movable receptacle 30 of transfer drum 25. Continuously rotating transfer drums 25 and 26 then transport articles 17 in the transverse axial direction for further processing. In the same way and continuously, successive groups of articles 17 are transferred from longitudinal conveyor 15 to transverse conveyor 23 via the plurality of receptacles 13 of conveying device 11.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. An apparatus for transferring rod-shaped articles from a longitudinal conveyor transporting the articles in a longitudinal axial direction onto a transverse conveyor transporting the articles in a transverse axial direction, in which the directions of transport of the longitudinal conveyor and the transverse conveyor are oriented transversely to each other, said apparatus comprising:

a conveying device having receptacles;

said receptacles being structured and arranged to receive a plurality of articles transported adjacent each other on a track of the longitudinal conveyor and to discharge the articles as a plurality of groups of articles onto different tracks of the transverse conveyor, wherein at least one of the plurality of groups comprises more than one article.

2. The apparatus in accordance with claim 1, wherein the articles comprise cigarettes.

3. The apparatus in accordance with claim 1, wherein said plurality of articles comprises more than two articles.

4. The apparatus in accordance with claim 1, wherein said conveying device comprises a single drum with several receptacles structured and arranged to simultaneously receive more than two articles from the longitudinal conveyor.

5. The apparatus in accordance with claim 4, wherein said conveying device is structured and arranged to simultaneously receive four articles and to discharge the articles in two groups of two.

6. The apparatus in accordance with claim 4, wherein said receptacles are structured and arranged to simultaneously receive four articles and to discharge the articles in two groups of two.

7. The apparatus in accordance with claim 4, wherein each of said receptacles are structured and arranged to simultaneously receive four articles and to discharge the articles in two groups of two.

8. The apparatus in accordance with claim 4, wherein said drum comprises a plurality of arms, and each arm is coupled to a receptacle.

9. The apparatus in accordance with claim 8, wherein said drum comprises between seven and nine arms, and each receptacle is structured and arranged to receive four articles.

10. The apparatus in accordance with claim 4, wherein said drum is rotatably driven about an axis of rotation oriented transversely to the direction of transport the longitudinal conveyor.

11. The apparatus in accordance with claim 10, wherein said axis of rotation is oriented in the direction of transport of the transverse conveyor.

12. The apparatus in accordance with claim 10, wherein said receptacles are rotatably driven relative to said drum.

13. The apparatus in accordance with claim 10, wherein said drum comprises a plurality of arms, in which each arm is coupled to a receptacle, and said arms are rotatably driven relative to said drum.

14. The apparatus in accordance with claim 1, wherein said receptacles are arranged to engage the articles from above.

15. The apparatus in accordance with claim 4, wherein the different tracks of the transverse conveyor comprise two separate transfer drums.

16. The apparatus in accordance with claim 15, wherein said two transfer drums are functionally connected to said single drum.

17. The apparatus in accordance with claim 15, wherein said two transfer drums are arranged above the track of the longitudinal conveyor.

18. The apparatus in accordance with claim 17, wherein axes of rotation of said two transfer drums are arranged above the track of the longitudinal conveyor.

19. The apparatus in accordance with claim 15, wherein said two transfer drums are drivable in opposite directions.

20. A method for transferring rod-shaped articles from a longitudinal conveyor transporting the articles in a longitudinal axial direction onto a transverse conveyor transporting the articles in a transverse axial direction, in which the directions of transport of the longitudinal conveyor and the transverse conveyor are oriented transversely to each other, said method comprising:

receiving a plurality of rod-shaped articles arranged adjacent each other on a track of the longitudinal conveyor;

rotating the plurality of articles through a predetermined angle; and discharging the plurality of articles in groups onto separate tracks of the transverse conveyor wherein at least one of the groups comprises more than one article.

21. The method in accordance with claim 20, wherein the plurality of rod-shaped articles comprise cigarettes.

22. the method in accordance with clam 20, wherein a conveying device is provided to receive, rotate, and discharge the plurality of articles.

23. The method in accordance with claim 20, wherein the discharging of the groups of articles occurs with staggering in time and place.

24. The method in accordance with claim 20, wherein the plurality of articles comprise four articles, and the receiving comprises simultaneously receiving the four articles.

25. The method in accordance with claim 20, wherein the discharging comprises discharging a first group of articles after rotating the articles through an angle of 90° and discharging a second group of articles after rotating the second group through and angle of 270°.

* * * * *